United States Patent [19]

Bluver et al.

[11] 4,386,868

[45] Jun. 7, 1983

[54] LEADER PIN LOCKING DEVICE

[76] Inventors: David B. Bluver, 2 S. Forrest Ave.; Carl S. Nelson, 742 Hickory, both of Arlington Heights, Ill. 60004

[21] Appl. No.: 224,104

[22] Filed: Jan. 12, 1981

[51] Int. Cl.[3] ..... B22C 21/10

[52] U.S. Cl. ..... 403/24; 403/14; 164/387; 249/205

[58] Field of Search ..... 403/13, 14, 292, 24; 164/387, 385; 249/205

[56] References Cited

U.S. PATENT DOCUMENTS

| | | | |
|---|---|---|---|
| 2,531,965 | 11/1950 | Beck et al. | 249/205 |
| 3,472,312 | 10/1969 | Rusk | 164/387 |
| 3,986,548 | 10/1976 | Rusk et al. | 164/387 |
| 4,199,313 | 4/1980 | Bohnenberger | 164/387 X |

FOREIGN PATENT DOCUMENTS

| | | | |
|---|---|---|---|
| 1426643 | 12/1965 | France | 403/292 |

*Primary Examiner*—Andrew V. Kundrat

*Attorney, Agent, or Firm*—Laff, Whitesel, Conte & Saret

[57] ABSTRACT

A leader pin for guiding and directing the halves of a mold as it opens and closes. The pin has a base, a shoulder at one end of the base, and a frustoconical tapered section which extends outwardly from a ledge on the base. A cylindrical guide pin projects outwardly from the narrow end of the tapered section. The tapered section and the guide pin fit into a complementary tapered and cylindrical opening in the sleeve of a bushing. The two tapered sections accurately guide, direct, and align the mold halves, without the assistance of separate cones and conical orifices.

7 Claims, 4 Drawing Figures

LEADER PIN LOCKING DEVICE

This invention relates to leader pins and leader pin bushings for use in molds or similar tools and, more particularly, to leader pins and bushings which accurately align the sections of the mold to maintain close tolerances, even after substantial wear.

Molds generally have at least two halves which move together and apart during their routine cyclic operation. One of the mold halves usually includes at least four leader pins which fit into complementary bushings in the opposite mold half. When the mold closes, these pins and bushings align the two halves. The pins and bushings wear after many molding cycles. Thereafter, it is difficult to maintain the required tolerances during production, especially when the leader pins and bushings are merely cylindrical members.

After the pins and bushings wear, one or more tapered cones may be installed in one half of the mold or die, with complementary, cone-receiving conical orifices being formed in the other half. Thereafter, when the mold halves come together, they are properly aligned by the cones slipping into and centering upon the conical orifices. However, the cones and conical orifices take up space on the mold surface, and they are expensive to install.

Thus, there is a need for leader pins and bushings which maintain accurate alignment of mold halves even after the pins and bushings wear, and especially when close tolerances must be maintained.

Accordingly, an object of this invention is to provide new and improved leader pins and bushings for aligning the opposing halves of molds and similar tools. Another object is to provide leader pins and bushings which maintain accurate alignment of mold or die halves, substantially regardless of wear.

Still another object of the invention is to provide new and improved leader pins and bushings which maintain accurate alignment of mold halves when close tolerances must be maintained.

In keeping with an aspect of the invention, a leader pin has a cylindrical base portion with a shoulder on one end and a generally frustoconical tapered section on the other end. The broad end of the tapered section has a diameter which is smaller than the diameter of the base in order to form a circumferential ledge. A guide pin extends outwardly from the narrow end of the tapered section. The tapered section and the guide pin fit into an opening in a bushing having complementary contours. The bushing opening has a portion for receiving the guide pin and a tapered receptical portion which corresponds to the tapered section of the leader pin. Pin travel within the bushing is limited by an abutment of the ledge on the pin, against the end of the bushing. The tapered portion on the pin centers in the complementary tapered section of the bushing opening.

The invention will be best understood by reference to the following description of an embodiment of the invention taken in conjunction with the accompanying drawings, in which.

Figure 1:
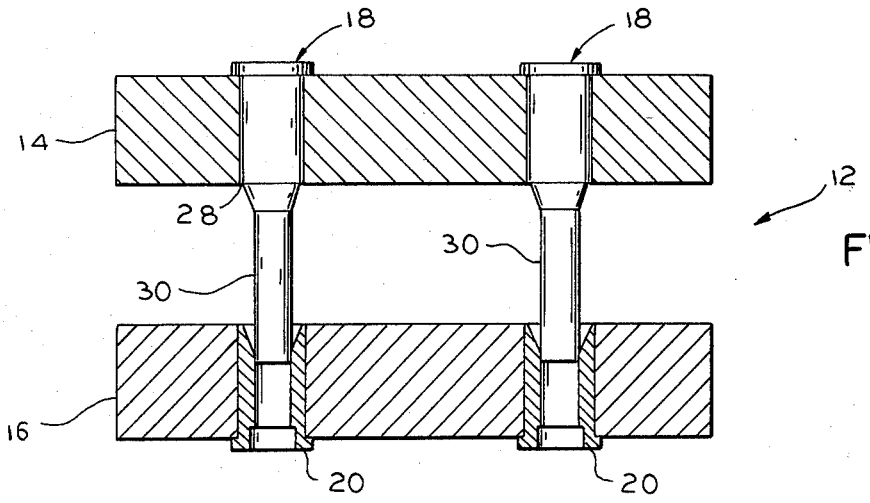
FIG. 1 is a side view (in cross section) of a mold, with the mold halves open.
Figure 2:
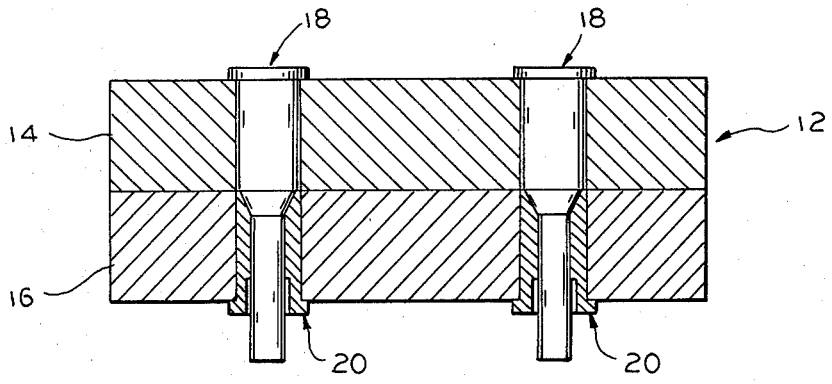
FIG. 2 is a side view (in cross section) of the same mold, with the mold halves closed.

A mold or similar tool 12 (FIGS. 1 and 2) has a top half 14 and a bottom half 16 which may be moved apart (FIG. 1) to remove a finished casting, or moved together (FIG. 2) for molding a new casting. The top half 14 and bottom half 16 are aligned by a plurality of leader pins 18 and bushings 20.

Figure 3:
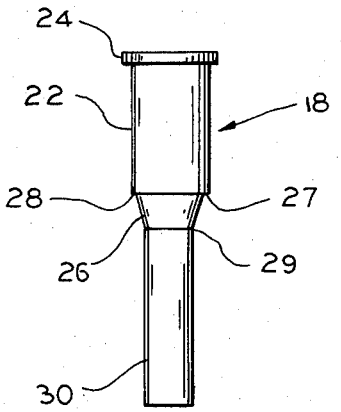
FIG. 3 is a elevation view of a leader pin incorporating the principles of the invention.

Leader pin 18 (FIG. 3) has a generally cylindrical base 22 terminating at one end in a shoulder 24. A generally frustoconical tapered portion 26 has a broad end 27 integrally formed on the base 22 and a narrow end 29 opposite base 22. The broad end 27 has a diameter which is smaller than the diameter of the cylindrical base 22, thereby exposing a flat-topped concentric, circumferential ledge 28 on base 22, adjacent tapered portion 26. A guide pin 30 projects beyond the narrow end of the tapered portion 26. The guide pin 30 is approximately the same diameter as the narrow end 29 of tapered portion 26.

Figure 4:
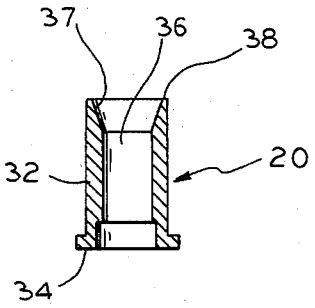
FIG. 4 is a elevation view (in cross section) of a bushing incorporating the principles of the invention.

Bushing 20 (FIG. 4) includes a generally cylindrical sleeve 32 having a lower end terminating in an outstanding shoulder 34. Inside bushing 20, an opening 36 has internal contours 37 which complement the tapered portion 26 and guide pin 30 so that the pin 18 fits snugly into the opening. The upper end of bushing 20 terminates at a ledge 38 which is adjacent the opening 36 and is opposite leader pin ledge 28 when the mold is closed.

Most molds have at least four leader pins 18 and oppositely disposed bushings 20. The leader pins 18 may be placed in either the top half 14 or bottom half 16 of mold 12. Generally, all of the leader pins 18 are mounted on one half and all bushings are formed in the opposite half. The leader pins 18 and bushings 20 may be secured in the mold by any suitable means.

Normally, pin ledge 28 and bushing ledge 38 are flush with the corresponding surfaces of the mold 12. When the top half 14 and bottom half 16 are completely separated (FIG. 1). generally the pin 18 remains at least partially inside a portion of opening 36. When the mold halves come together, the tapered pin section 26 presses against or is guided by the correspondingly tapered part 37 of opening 36 to properly align the top 14 and bottom 16. The leader pin ledge 28 and bushing ledge 38 also meet, in order to prevent excessive pressure from being exerted against the tapered portion of opening 36.

While the leader pin 18 and bushing 20 have been described above in connection with molds, they may also be used in connection with any other suitable devices which must open and close, such as stamping dies, and the like.

Those who are skilled in the art will readily perceive how to modify the system. Therefore, the appended claims are to be construed to cover all equivalent structures which fall within the true scope and spirit of the invention.

I claim:

1. A leader pin and bushing combination for aligning mold halves, said leader pin integrally comprising a cylindrical base, a frustoconical tapered portion with a broad end and a narrow end integrally formed at its broad end onto one end of said cylindrical base, said broad end of said tapered section having a diameter which is smaller than the diameter of said cylindrical base, exposing a coaxial circumferential ledge on one end of said base, a guide pin projecting away from said narrow end; said bushing comprising a sleeve having an opening with internal contours which are complementary to the outer contours of said tapered section and said guide pin, the tapered portions of said leader pin and said bushing guiding and directing said mold halves into alignment as they close, and said bushing includes a bushing ledge on the end of said sleeve adjacent said tapered section of said bushing opening, said ledges coming into abutment when said mold halves close in order to limit pressure between the tapered sections on said leader pin and in said bushing.

2. A leader pin and bushing combination for aligning mold halves, said leader pin integrally comprising a cylindrical base, a frustoconical tapered portion with a broad end and a narrow and integrally formed at its broad end onto one end of said cylindrical base, and a guide pin projecting away from said narrow and; said leader pin including a shoulder having a diameter which is larger than the diameter of said tapered portion formed on the end of said cylindrical base opposite said tapered portion, said bushing comprising a sleeve having an opening with internal contours which are complementary to the outer contours of said tapered section and said guide pin, the tapered portions of said leader pin and said bushing guiding and directing said mold halves into alignment as they close.

3. A leader pin and bushing combination for aligning mold halves, said leader pin integrally comprising a cylindrical base, a frustoconical tapered portion with a broad end and a narrow end integrally formed at its broad end onto one end of said cylindrical base, and a guide pin projecting away from said narrow end; said bushing comprising a sleeve having an opening with internal contours which are complementary to the outer contours of said tapered section and said guide pin, the tapered portions of said leader pin and said bushing guiding and directing said mold halves into alignment as they close, said bushing including a shoulder on the end of said sleeve.

4. A tool having opposed parts which open and close during a work cycle, a plurality of leader pins mounted on at least one of said parts with opposing bushings mounted on the other of said parts, said leader pins and bushing cooperating to form guides for aligning said parts as they open and close, said leader pins and bushing having complementary contours comprising first elongated cylindrical members for slidingly guiding said parts during final closing movement of said parts, and second and frustoconical members formed on the end of said cylindrical member for aligning said parts as they move toward said final closing movement, said frustoconical parts in said complementary contours terminating in abutting ledges which come together to limit closing travel of said parts in order to limit the pressure between said frustoconical members.

5. The tool of claim 4 wherein said parts are opposing halves of a mold which together form a cavity for molding parts.

6. The tool of claim 4 or claim 6 wherein said leader pins and said bushings are separate and removable parts which may be replaced when worn, and shoulders on said pins and bushings for accurately positioning them when they are replaced.

7. The tool of claim 6 wherein said abutting ledges are substantially flush with the surface of said parts when the shoulders of said leader pins and bushings are accurately positioned.

* * * * *